US005367777A

United States Patent [19]

Nguyen et al.

[11] Patent Number: 5,367,777

[45] Date of Patent: Nov. 29, 1994

[54] WOOD PENCIL SHARPENER AND POCKET HOLDER

[76] Inventors: Caroline P. Nguyen, 980 Kiely Blvd. #119; James M. Harrell, Jr., 990 Kiely Blvd. #E, both of Santa Clara, Calif. 95051

[21] Appl. No.: 140,570

[22] Filed: Oct. 25, 1993

[51] Int. Cl.[5] ..... B43L 23/00

[52] U.S. Cl. ..... 30/459; 30/458

[58] Field of Search ..... 30/451, 457, 458, 460, 30/459; 7/160

[56] References Cited

U.S. PATENT DOCUMENTS

| | | | |
|---|---|---|---|
| 1,059,725 | 4/1913 | Furst | 120/90 |
| 1,596,698 | 8/1926 | von Sandt | 30/451 X |
| 2,287,703 | 6/1942 | Nyberg et al. | 120/84 |

*Primary Examiner*—Douglas D. Watts

*Attorney, Agent, or Firm*—Fliesler, Dubb, Meyer & Lovejoy

[57] ABSTRACT

A Wood Pencil Sharpener and Pocket Holder which allows a pencil to be stored in a shirt pocket such that the pencil and pencil point are contained within a tube and covered sharpener, thus eliminating lead pencil marks on the shirt and inside the shirt pocket. In addition, this device can sharpen the pencil while containing the loose shavings within a detachable cover.

1 Claim, 2 Drawing Sheets

WOOD PENCIL SHARPENER AND POCKET HOLDER

BACKGROUND OF THE INVENTION

1. Field of the Invention

The subject invention generally pertains to wood pencil pocket holders and more specifically to devices comprising a combined wood pencil sharpener and pocket holder.

2. Description of Related Art

Most pencil clips are devices that slide over a wood pencil and allow it to be secured to a shirt pocket. Some of these pencil clips are combined with pencil sharpeners. The shortcomings of these devices are that they do not have a protective cap which sheath the pencil's sharp lead point from poking a person while resting in the shirt pocket or leaving lead residue on the shirt itself. In addition, the sharpeners do not have covers surrounding them to collect the pencil's wood shavings.

By integrating the pencil clip to a slim covered sharpener via a connecting tube, the pencil can be inserted and stored in this protected shirt pocket holder and sharpened by this device while containing the loose wood shavings and lead within a detachable cover.

SUMMARY OF THE INVENTION

To avoid the limitations and problems with present methods of storing wooden pencils in shirt pockets, it is an object of the subject invention to completely contain the pointed end of the pencil within the enclosed sharpener while resting in the shirt pocket.

Another object of the subject invention is to sharpen the pencil while containing the loose wood shavings and lead within a detachable cover.

DESCRIPTION OF PREFERRED EMBODIMENT

Figure 1:
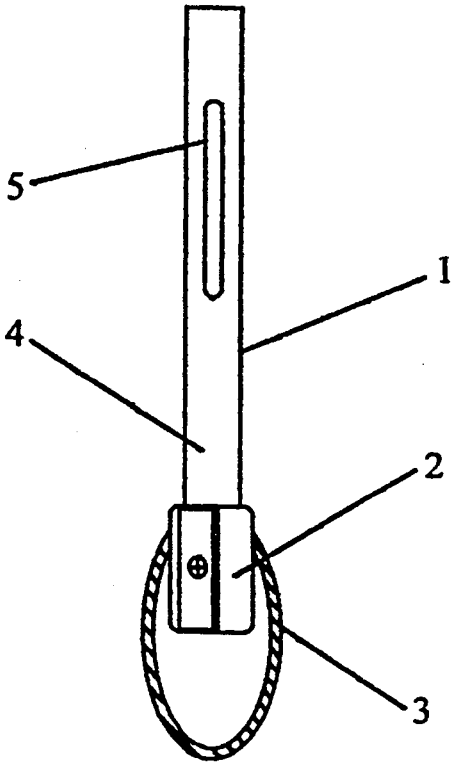
FIG. 1 illustrates a top view of the Wood Pencil Sharpener and Pocket Holder partly in cross-section to illustrate the wood pencil sharpener inside the wood shavings container.
Figure 2:
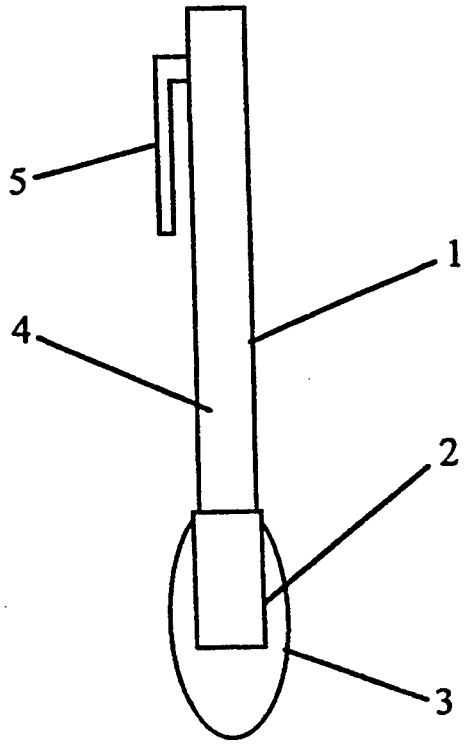
FIG. 2 illustrates a side view of the Wood Pencil Sharpener and Pocket Holder.

Referring to FIG. 1, the wood pencil sharpener and pocket holder 1, comprising a pencil sharpener 2 connected to a tube 4 suitably large to contain a standard diameter pencil. Said tube 4 is connected to a shirt pocket holder clip 5. Said pencil sharpener 2 is covered by a detachable wood shavings container 3.

Although the invention is described with respect to a preferred embodiment, modifications thereto will be apparent to those skilled in the art. Therefore, the scope of the invention is to be determined by reference to the claim which follows:

We claim:

1. A wood pencil sharpener and pocket holder comprising:

a hollow tubular member for holding a pencil;

a pocket clip attached to said tubular member near one end thereof;

a pencil sharpener attached to the opposite end of said tubular member;

a cover member for collecting pencil shavings covering said sharpener and detachable from said sharpener for emptying said shavings from said cover member, said pocket clip being so attached to said tubular member that, when said clip is attached to the edge of a shirt pocket, said sharpener is located beneath said clip allowing a pencil to be removed by lifting the same from the hollow tubular member without having to detach the clip from the edge of the shirt pocket.

* * * * *